US006919883B2

(12) United States Patent
Lee

(10) Patent No.: US 6,919,883 B2
(45) Date of Patent: Jul. 19, 2005

(54) CHARGE CHARACTERISTIC COMPENSATING CIRCUIT FOR LIQUID CRYSTAL DISPLAY PANEL

(75) Inventor: Moo Jin Lee, Taegu (KR)

(73) Assignee: LG Philips LCD Co., Ltd., Seoul (KR)

( * ) Notice: Subject to any disclaimer, the term of this patent is extended or adjusted under 35 U.S.C. 154(b) by 234 days.

(21) Appl. No.: 09/742,383

(22) Filed: Dec. 22, 2000

(65) Prior Publication Data

US 2001/0040543 A1 Nov. 15, 2001

(30) Foreign Application Priority Data

Dec. 23, 1999 (KR) ..... 99-61230

(51) Int. Cl.[7] ..... G09G 5/00
(52) U.S. Cl. ..... 345/204
(58) Field of Search ..... 345/204, 87, 89, 345/95–102; 315/224, 169.3; 349/161; 320/116; 340/14.63

(56) References Cited

U.S. PATENT DOCUMENTS 4,370,606 A * 1/1983 Kakumoto et al. ..... 320/141
4,377,742 A * 3/1983 Kawabata et al. ..... 250/204
5,119,215 A * 6/1992 Marks et al. ..... 349/161
5,192,945 A * 3/1993 Kusada ..... 345/88
5,204,660 A * 4/1993 Kamagami et al. ..... 345/95
5,250,937 A * 10/1993 Kikuo et al. ..... 345/89
5,497,146 A * 3/1996 Hebiguchi ..... 340/14.63
5,534,889 A * 7/1996 Reents et al. ..... 345/89
5,627,457 A * 5/1997 Ishiyama et al. ..... 323/318
5,717,421 A * 2/1998 Katakura et al. ..... 345/101
5,940,055 A * 8/1999 Lee ..... 345/87
6,067,062 A * 5/2000 Takasu et al. ..... 345/87
6,075,511 A * 6/2000 Iwasaki et al. ..... 345/101
6,184,631 B1 * 2/2001 Noma et al. ..... 315/224
6,201,523 B1 * 3/2001 Akiyama et al. ..... 345/96
6,307,308 B1 * 10/2001 Teichmann et al. .... 313/231.11
6,323,490 B1 * 11/2001 Ikeda et al. ..... 250/370.09
6,331,844 B1 * 12/2001 Okumura et al. ..... 345/87
6,348,910 B1 * 2/2002 Yamamoto et al. ..... 345/102
6,396,243 B2 * 5/2002 Odaohhara ..... 320/116
6,570,547 B1 * 5/2003 Kim et al. ..... 345/75.2
6,667,730 B1 * 12/2003 Taguchi et al. ..... 345/99
6,731,265 B1 * 5/2004 Kokuhata et al. ..... 345/101
2004/0027508 A1 * 2/2004 Akiyama et al. ..... 349/56

* cited by examiner

*Primary Examiner*—Vijay Shankar
*Assistant Examiner*—Prabodh Dharia
(74) *Attorney, Agent, or Firm*—Birch, Stewart, Kolasch & Birch, LLP

(57) ABSTRACT

A charge characteristic compensating circuit for a liquid crystal display panel for maintaining a charge characteristic of the liquid crystal display panel independently of ambient temperature change to prevent deterioration of images displayed. A plurality of liquid crystal cells control light transmission in response to data signals from the data lines. A plurality of thin film transistors switch the data signals from the data lines to the liquid crystal cells in response to signals on the gate lines. A voltage supply generates a gate voltage required for the gate lines. A gate line driver applies the gate voltage from the voltage supply to the gate lines to drive the gate lines. A gate line controller responds to a change in the ambient temperature to vary a controlling signal applied to the gate line driver.

8 Claims, 5 Drawing Sheets

CHARGE CHARACTERISTIC COMPENSATING CIRCUIT FOR LIQUID CRYSTAL DISPLAY PANEL

BACKGROUND OF THE INVENTION

1. Field of the Invention

This invention relates to a drive circuit for a liquid crystal display panel having thin film transistors (TFT's) switching a data signal to be applied to a liquid crystal cell, and more particularly to a TFT charge characteristic compensating circuit for maintaining a constant charge characteristic of a liquid crystal cell despite changes in ambient temperature.

2. Description of the Related Art

Generally, a liquid crystal display (LCD) panel includes liquid crystal cells, which respond to a voltage level of a data signal to control a light transmissivity, and thin film transistors (TFTs) for switching the data signal to be applied to each liquid crystal cell. The TFT's on the LCD panel have resistance values that decrease gradually as the ambient temperature increases. Also, the liquid crystal cells have a dielectric constant that increases gradually as the ambient temperature increases.

Since both the resistance values of the TFT's and the dielectric constant of the liquid crystal cells change as the ambient temperature changes, the amount of electric charge in the liquid crystal cell, via the TFT, also changes as the ambient temperature changes. This in turn causes the light transmission response of the liquid crystal cell to change with temperature as well. Thus, as the ambient temperature varies, the quality of the image displayed from the LCD panel deteriorates.

A conventional driving apparatus for an LCD panel is shown in FIG. 1. The conventional LCD panel driving apparatus includes a DC voltage converter 12, a gate line driver 14, and an LCD panel 10. The LCD panel 10 has a liquid crystal cell CLC positioned at an intersection between the a line GL and a data line DL, and a TFT MN connected among the liquid crystal cell CLC and the gate and data lines GL and DL. The liquid crystal cell CLC and the TFT MN are arranged in a matrix.

The DC voltage converter 12 supplies DC voltages required for the gate line driver 14. The DC voltage converter 12 receives a DC voltage Vd via a power input line 11 from a power supply (not shown). Also, the DC voltage converter 12 outputs a high-level gate voltage Vgh and a low-level gate voltage Vgl. The high-level gate voltage Vgh is applied, via a first resistor R1, to the gate line driver 14 and the low-level gate voltage Vgl is applied, via a second resistor R2, to the gate line driver 14 as well.

The gate line driver 14 alternates driving the gate line GL with a high level voltage and a low-level gate voltage. When the high level voltage is applied, the TFT MN turns on to apply a data signal on the data line DL to the liquid crystal cell CLC. The liquid crystal cell CLC is charged by the data signal while the TFT MN is on.

The high level voltage applied to the gate line GL is constant regardless of the ambient temperature. However, because the TFT MN in the LCD panel 10 responds differently as the ambient temperature changes, the liquid crystal cell CLC is charged differently as the temperature changes as well. As noted above, this in turn creates a changing response of the light transmission of the liquid crystal cell CLC. Accordingly, the quality of the image displayed from the LCD panel deteriorates as the ambient temperature changes.

SUMMARY OF THE INVENTION

Accordingly, it is an object of the present invention to provide a charge characteristic compensating circuit for a liquid crystal display panel that is capable of constantly maintaining a charge characteristic of the liquid crystal display panel independently of temperature variations to prevent deterioration of images displayed.

In order to achieve these and other objects of the invention, a charge characteristic compensating circuit for a liquid crystal display panel according to an embodiment of the present invention includes a voltage supply for generating a gate voltage required for the gate lines; a gate line driver for applying the gate voltage from the voltage supply to the gate lines to drive the gate lines; and a current controller for responding to a change in the ambient temperature to change an amount of current of the gate voltage to be applied from the voltage supply to the gate line driver.

A charge characteristic compensating circuit for a liquid crystal display panel according to another embodiment of the present invention includes a voltage supply for generating a gate voltage required for the gate lines; a gate line driver for applying the gate voltage from the voltage supply to the gate lines to drive the gate lines; and a current controller for responding to a change in the ambient temperature to change a voltage level of the gate voltage to be applied from the voltage supply to the gate line driver.

Another aspect of the charge characteristic compensating circuit for a liquid crystal display includes a voltage converter generating a high level gate voltage; a gate line controller receiving the high level gate voltage from the voltage converter and supplying a controlling signal that varies as an ambient temperature varies; and a gate line driver receiving the controlling signal from said gate line controller and driving a gate line.

Also a method to compensate for a charge characteristic of a liquid crystal display panel includes supplying a controlling signal that varies as an ambient temperature varies and driving a gate line according to the controlling signal.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
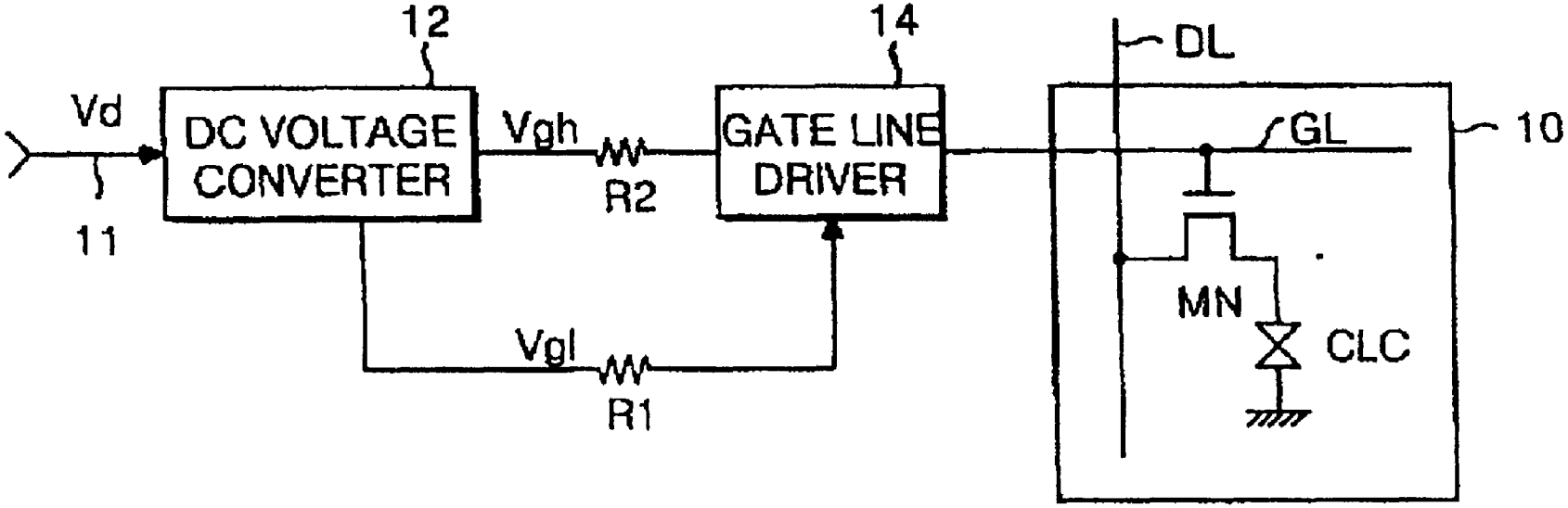
FIG. 1 CONVENTIONAL ART
FIG. 1 is a schematic block diagram showing a configuration of a conventional gate line driving apparatus for a liquid crystal display panel.
Figure 2:
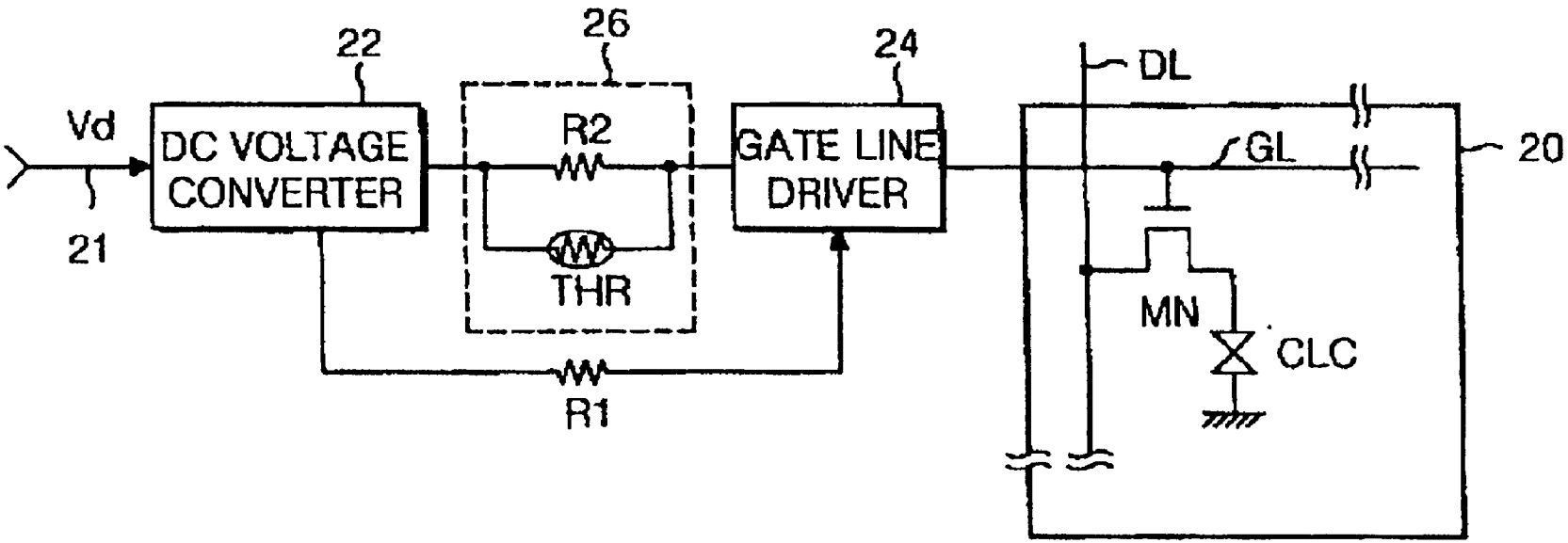
FIG. 2 is a block circuit diagram of a gate line driving apparatus for a liquid crystal display panel employing which a charge characteristic compensating circuit for the liquid crystal display panel according to an embodiment of the present invention.

A driving apparatus for a liquid crystal display (LCD) panel employing a charge characteristic compensating circuit for the LCD panel according to an embodiment of the present invention is shown in FIG. 2. The driving apparatus includes a DC voltage converter 22, a gate line controller 26, a gate line driver 24, and an LCD panel 20. The LCD panel 20 has a liquid crystal cell CLC positioned at an intersection between a gate line GL and a data line DL, and a TFT MN connected among the liquid crystal cell CLC and the gate and data lines GL and DL. The liquid crystal cell CLC and the TFT MN are arranged in a matrix.

The DC voltage converter 22 receives a DC voltage Vd via a power input line 21 from a power supply (not shown), and generates a high-level gate voltage Vgh and a low-level gate voltage Vgl in response to the Vd voltage. The high-level gate voltage Vgh is applied, via a gate line controller 26, to the gate line driver 24 while the low-level gate voltage Vgl is applied, via a first resistor R1, also to the gate line driver 24.

The gate line driver 24 alternates driving the gate line GL with the high level voltage and a low level voltage in response to Vgh and Vgl. When the high level voltage is applied to the gate line GL, the TFT MN turns on to apply a data signal from the data line DL to the liquid crystal cell CLC. The liquid crystal cell CLC is charged by the data signal while the TFT MN is on.

As noted above, Vgh is applied to the gate line driver 24 via the gate line controller 26. In this aspect, the gate line controller 26 acts as a current controller controlling the amount of current supplied to the gate line driver 24. The gate line controller 26 includes a second resistor R2 and a thermistor THR connected in parallel between the DC voltage converter 22 and the gate line driver 24. The parallel connection of the second resistor R2 and the thermistor THR changes the output impedance of the DC voltage converter 22 in accordance with the temperature change.

More specifically, as the ambient temperature rises, the resistance of the thermistor THR increases. The resistance of the thermistor may THR be greater than the resistance of R2. The increased resistance of the thermistor THR increases the equivalent resistance of the gate line controller 26 and thus decreases the amount of current when the signal Vgh is applied to the gate line driver 24.

On the other hand, as the ambient temperature drops, the resistance of the thermistor THR decreases. The resistance of the thermistor THR may be less than the resistance of R2. The decreased resistance of the thermistor THR decreases the equivalent resistance of the gate line controller 26 and thus increases the amount of current when the signal Vgh is applied is applied to the gate line driver 24.

In this instance, a positive temperature coefficient thermistor, i.e., a thermistor whose resistance increases as the ambient temperature increases, can be used.

Figure 3:
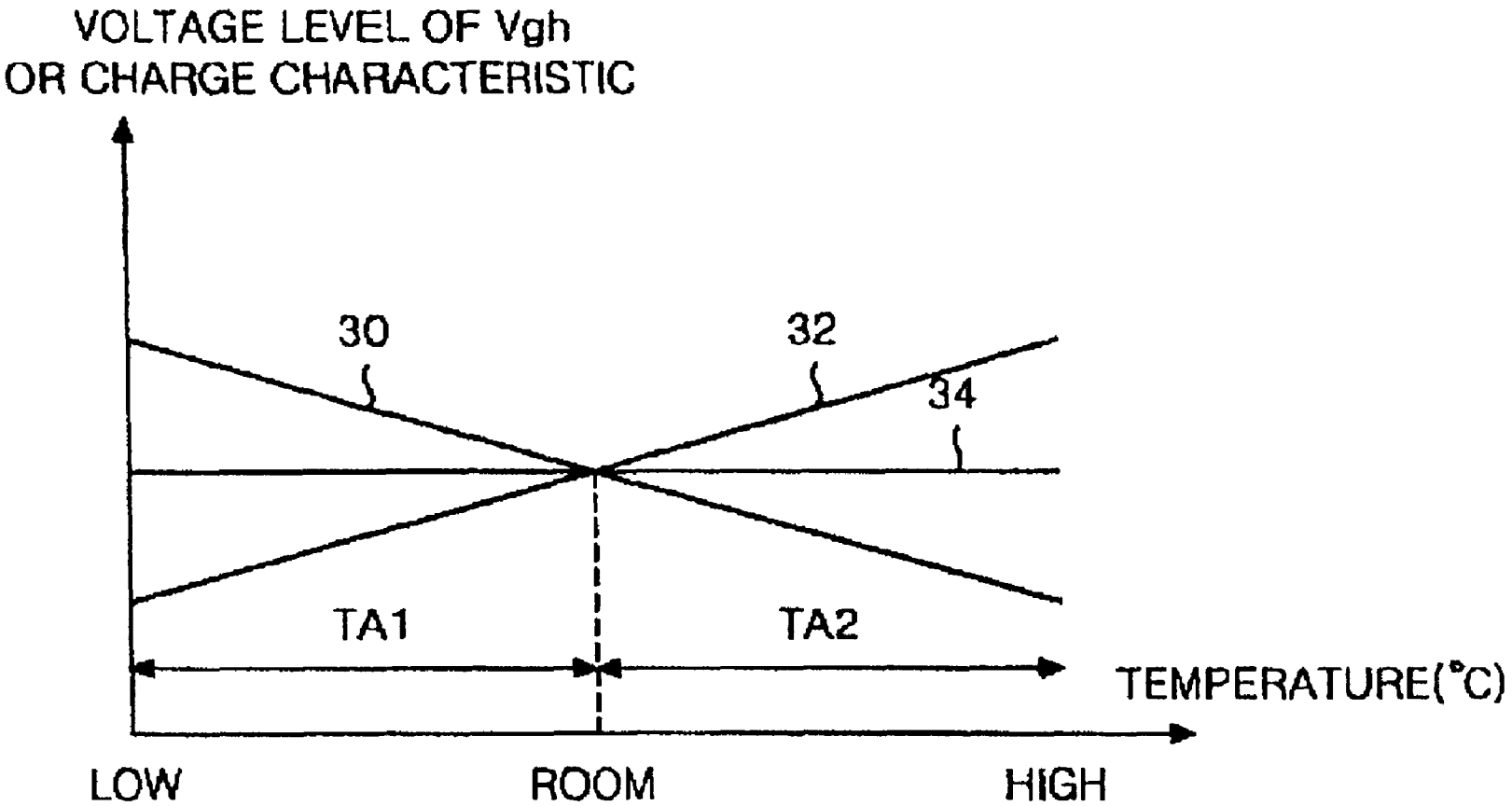
FIG. 3 is a graph for explaining a charge characteristic of the liquid crystal display panel in FIG. 2.

A charge characteristic of the liquid crystal cell CLC varies according to an amount of current applied to the gate line GL. In FIG. 3, the charge characteristic of the CLC is shown when high-level gate voltage signal Vgh is output from.

As noted previously, the resistance of the TFT MN decreases as the ambient temperature increases causing the response of the CLC to change as well. In FIG. 3, this is shown by the charge characteristic line 32 in the temperature region TA2. To compensate, the size of current path from the data line DL through the TFT MN to the CLC needs to be reduced. This is accomplished by reducing the amount of current supplied to the gate line GL.

In FIG. 2, the resistance of the gate line controller 26 increases as the ambient temperature increases due to the positive temperature coefficient thermistor THR. The increase in resistance leads to less current being supplied to the gate line driver 24 and consequently to the gate line GL. This in turn causes a reduction in the size of the current path from the data line DL to the CLC via the TFT MN.

As shown in FIG. 3, as the current path narrows, the effect is to decrease the charge characteristic as shown by the characteristic line 30 in temperature area TA2. Thus the data signal from the data line to the liquid crystal cell CLC is attenuated and compensates for the decreasing resistance of the TFT MN.

In other words, as the ambient temperature rises, the natural charge characteristic would be as shown by the characteristic line 32 in FIG. 3 in the temperature region TA2. However, the compensation circuit reduces the voltage level of Vgh applied to the gate line GL by reducing the amount of current applied to the gate line driver 24, as shown by the characteristic line 30. The end result is that a constant charge characteristic is maintained, as shown by characteristic line 34, which is the charge characteristic of the CLC at room temperature.

On the other hand, the resistance of the TFT MN increases as the ambient temperature decreases. The charge characteristic of the CLC is shown by characteristic line 32 in temperature region TA1 of FIG. 3. To compensate, the current path from the data line DL through the TFT MN to the CLC needs to be increased. This is accomplished by increasing the amount of current supplied to the gate line GL.

As seen in FIG. 2, the equivalent resistance of the gate line controller 26 decreases as the ambient temperature decreases. This decrease in resistance leads to more current to be supplied to the gate line driver 24 and consequently to the gate line GL. This in turn causes a widening in the current path from the data line DL to the CLC via the TFT MN.

As shown in FIG. 3, when the current path widens, the charge characteristic of the CLC increases like the characteristic line 30 in temperature area TA1. Thus the data signal to the liquid crystal cell CLC is increased and compensates for the increased resistance of the TFT MN.

In other words, as the ambient temperature falls, the natural charge characteristic would be as shown by the characteristic line 32 in FIG. 3 in the temperature region TA1. However, the compensation circuit increases the high level voltage applied to the gate line GL by increasing the amount of current applied to the gate line driver 24, as shown by the characteristic line 30. The end result is that a constant charge characteristic is maintained, as shown by characteristic line 34.

As described above, the amount of current supplied to the gate line driver 24, when applying Vgh, is changed to maintain the charge characteristic of the liquid crystal cell CLC. This in turn allows the light transmission response of the CLC to be independent of the ambient temperature, and thus prevent image display deterioration.

Figure 4:
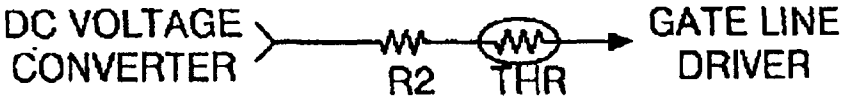
FIG. 4 is a schematic view of another example of the gate line controller of FIG. 2.

FIG. 4 shows another example of the gate line controller 26 in FIG. 2. The gate line controller 26 of FIG. 4 includes a second resistor R2 and thermistor THR connected, in series, between the DC voltage converter 22 and the gate line driver 24. Again, a positive temperature coefficient thermistor is used.

Like FIG. 2, the equivalent resistance of the gate line controller 26 rises and falls as the ambient temperature rises and falls, respectively. Thus, the amount of current supplied to the gate line driver 24 is reduced or increased, respectively, allowing the charge characteristic of the CLC to be maintained, as previously described.

Figure 5:
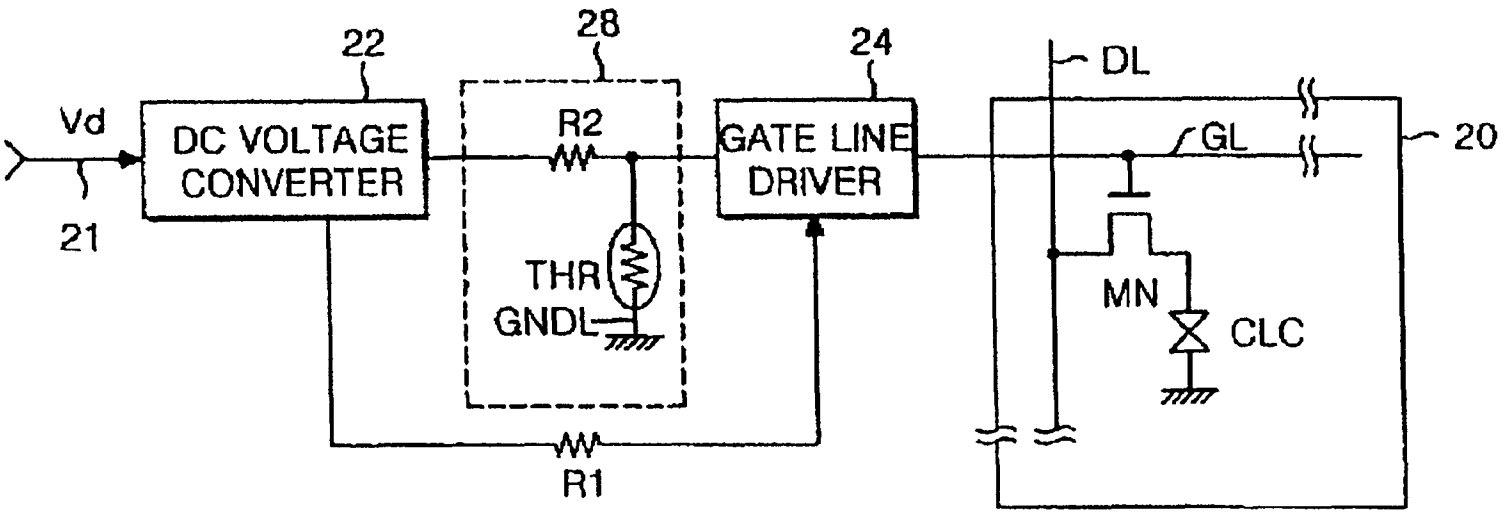
FIG. 5 is a block circuit diagram of a gate line driving apparatus for a liquid crystal display panel employing which a charge characteristic compensating circuit for the liquid crystal display panel according to another embodiment of the present invention.

In FIG. 5, a driving apparatus for an LCD panel employing a charge characteristic compensating circuit according to another embodiment is shown. In this embodiment, a negative temperature coefficient thermistor, i.e., a thermistor whose resistance decreases as the ambient temperature increases, is used.

The LCD panel driving apparatus includes a DC voltage converter 22, a gate line controller 28, a gate line driver 24, and an LCD panel 20. The DC voltage controller 22, the gate line drive 24, and the LCD panel 20 are similar to the components described in FIG. 2, and therefore the detailed description regarding these components will be omitted.

Note that the high-level gate voltage Vgh is applied, via a gate line controller 28, to the gate line driver 24, while the low-level gate voltage Vgl being applied, via a first resistor R1, also to the gate line driver 24. In this aspect, the gate line controller 28 acts as a voltage controller controlling the level of voltage supplied to the gate line driver 24.

The gate line controller 28 includes a second resistor R2 and a thermistor THR. The second resistor R2 is connected between the DC voltage converter 22 and the gate line driver 24, and the thermistor THR is connected between a connection node between the second resistor R2 and an input line of the gate line driver 24 and a ground voltage line GNDL.

The second resistor R2 and the thermistor THR act as a voltage divider of the high-level gate voltage Vgh from the DC voltage converter 22. The high level voltage applied to the gate line driver 24 increases as the resistance of the thermistor increases.

As noted above, the resistance of the TFT MN decreases as the ambient temperature increases leading to the charge characteristic as shown by the characteristic line 32 in temperature region TA2 of FIG. 3. This embodiment compensates by reducing the voltage applied to the gate line GL, i.e., the voltage applied to the gate line having the voltage characteristic as shown by characteristic line 30 of FIG. 3.

By using a negative temperature coefficient thermistor, the resistance of the thermistor THR in FIG. 5 decreases as the ambient temperature rises. Thus, as the ambient temperature rises, the high level voltage applied to the gate line GL by the gate line driver 24, when the signal Vgh is applied, falls accordingly, thus reducing the voltage applied to the gate line GL.

Conversely, the resistance of the TFT MN increases as the ambient temperature decreases leading to the charge characteristic as shown by the characteristic line 32 in temperature region TA1 of FIG. 3. In this situation, the resistance of the thermistor THR increases as the ambient temperature falls. Thus, as the ambient temperature falls, the voltage applied to the gate line GL by the gate line driver 24, when the signal Vgh is applied, rises accordingly, thus increasing the voltage applied to the gate line GL.

The end result is that constant charge characteristic, such as shown by the characteristic line 34 in FIG. 3, is maintained, and the image display does not deteriorate.

Figure 6:
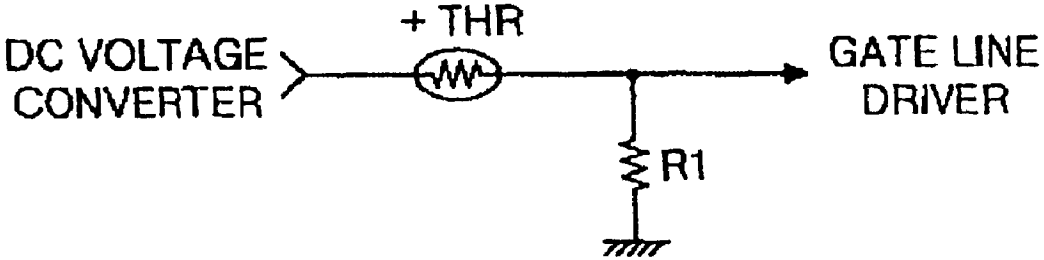
FIGS. 6 and 7 are schematic views of other examples of the gate line controller of FIG. 5.
Figure 7:
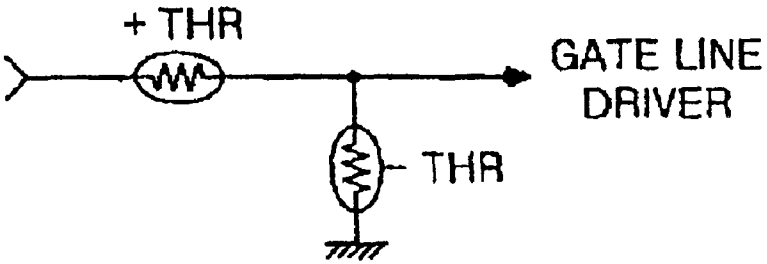

FIGS. 6 and 7 show alternate examples of the gate line controller 28 of FIG. 5. FIG. 6 show a similar voltage divider circuit configuration as in FIG. 5, except that a positive temperature coefficient thermistor is connected from the voltage converter 12 and a resistor R1 is connected between the input to the gate line driver 14 and ground. The alternative in FIG. 7 is similar to FIG. 6, except that a negative temperature coefficient thermistor is used in place of the resistor R1. In both configurations, like the configuration shown in FIG. 5, as the ambient temperature rises and falls, the high level voltage applied to the gate line GL falls and rises, respectively.

As described above, according to the present invention, the amount of current or the level of the high level voltage applied to the gate line of the liquid crystal display panel is changed in accordance with the ambient temperature. This maintains a constant charge characteristic of the liquid crystal cell despite temperature changes. Accordingly, a light transmitting responses of the liquid crystal cell also becomes independent of the changes in the ambient temperature. As a result, the quality of the image display is maintained.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A charge characteristic compensating circuit for a liquid crystal display panel including a plurality of liquid crystal cells arranged at each intersection between data lines and gate lines to control a light transmissivity in response to data signals from the data lines, and a plurality of switching devices for switching the data signals to be applied from the data lines to the liquid crystal cells in response to signals on the gate lines, the circuit comprising:

a voltage supply for generating a gate voltage required for the gate lines;

a gate line driver for applying the gate voltage from the voltage supply to the gate lines to drive the gate lines; and a current controller including a resistor and a thermistor for responding to a change in the ambient temperature to change an amount of current of the gate voltage to be applied from the voltage supply to the gate line driver, thereby changing a width of a current path from the data line to the liquid crystal cell.

2. The charge characteristic compensating circuit as claimed in claim 1, wherein said resistor and said thermistor are connected, in parallel, between the voltage supply and the gate line driver.

3. The charge characteristic compensating circuit as claimed in claim 1, wherein said resistor and said thermistor are connected, in series, between the voltage supply and the gate line driver.

4. The charge characteristic compensating circuit as claimed in claim 2, wherein the thermistor is a positive temperature coefficient thermistor.

5. The charge characteristic compensating circuit as claimed in claim 3, wherein the thermistor is a positive temperature coefficient thermistor.

6. A charge characteristic compensating circuit for a liquid crystal display panel including a plurality of liquid crystal cells arranged at each intersection between data lines and gate lines to control a light transmissivity in response to data signals from the data lines, and a plurality of switching devices for switching the data signals to be applied from the data lines to the liquid crystal cells in response to signals on the gate lines, the circuit, comprising:

a voltage supply for generating a gate voltage required for the gate lines;

a gate line driver for applying the gate voltage from the voltage supply to the gate lines to drive the gate lines; and a current controller including a resistor and a thermistor for responding to a change in the ambient temperature to change a voltage level of the gate voltage to be applied from the voltage supply to the gate line driver, thereby changing a width of a current path from the data line to the liquid crystal cell.

7. The charge characteristic compensating circuit as claimed in claim 6, wherein the current controller includes a resistive voltage divider connected between the voltage supply and the gate line driver and composed of said resistor and said thermistor.

8. The charge characteristic compensating circuit as claimed in claim 6, wherein the thermistor is a negative temperature coefficient thermistor.

* * * * *